United States Patent [19]

Huether

[11] Patent Number: 5,042,101

[45] Date of Patent: Aug. 27, 1991

[54] COLLAPSIBLE BRIDGE

[75] Inventor: Herbert Huether, Wangen, Fed. Rep. of Germany

[73] Assignee: Dornier GmbH, Friedrichshafen, Fed. Rep. of Germany

[21] Appl. No.: 343,734

[22] Filed: Apr. 27, 1989

[30] Foreign Application Priority Data

Apr. 29, 1988 [DE] Fed. Rep. of Germany ..... 3814502

[51] Int. Cl.[5] ..... E01D 15/12

[52] U.S. Cl. ..... 14/2.4; 14/5

[58] Field of Search ..... 14/2, 2.4, 5, 24, 25, 14/26, 1

[56] References Cited

U.S. PATENT DOCUMENTS

| | | | |
|---|---|---|---|
| 879,524 | 2/1908 | Collins | 14/5 |
| 4,017,932 | 4/1977 | Lotto et al. | 14/2.4 |
| 4,635,311 | 1/1987 | Helmke | 14/2.4 |
| 4,706,436 | 11/1987 | Mabey et al. | 14/4 X |

FOREIGN PATENT DOCUMENTS

| | | | |
|---|---|---|---|
| 2926594 | 1/1981 | Fed. Rep. of Germany | 14/2.4 |
| 2597129 | 10/1987 | France | 14/2.4 |

*Primary Examiner*—William P. Neuder

*Attorney, Agent, or Firm*—Ralf H. Siegemund

[57] ABSTRACT

A collapsible bridge for military purposes is assembled from a plurality of similarly constructed and interconnected bridge elements, each including two track plates, two girders and several length adjusted diagonal struts and tie rods, interconnected and configured so that the angular orientation of the girders is adjustable in relation to the track places, these adjustments being different for different bridge elements such that either the interconnected track plates or the interconnected girders or both approximate arches.

9 Claims, 9 Drawing Sheets

Fig. 9a
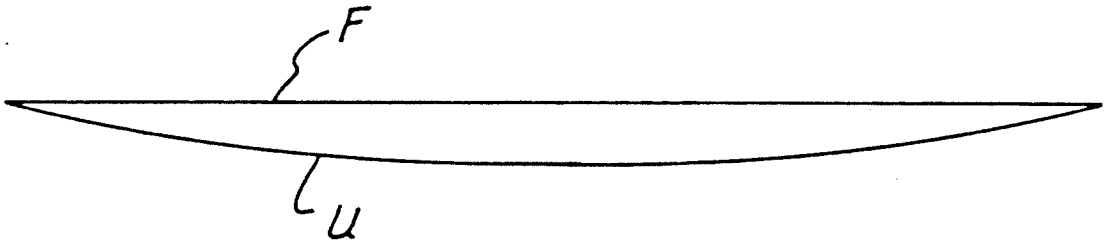
Fig. 9b
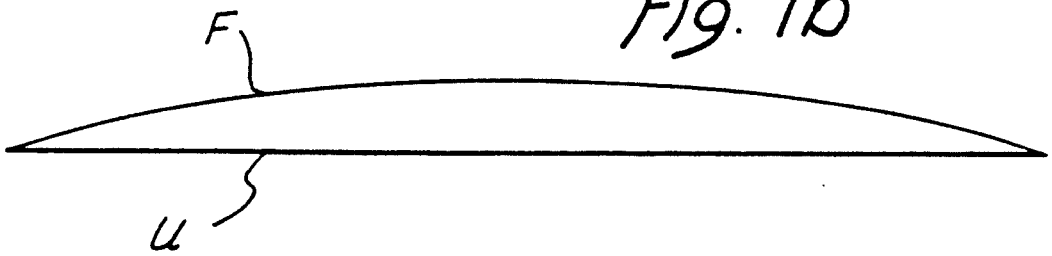
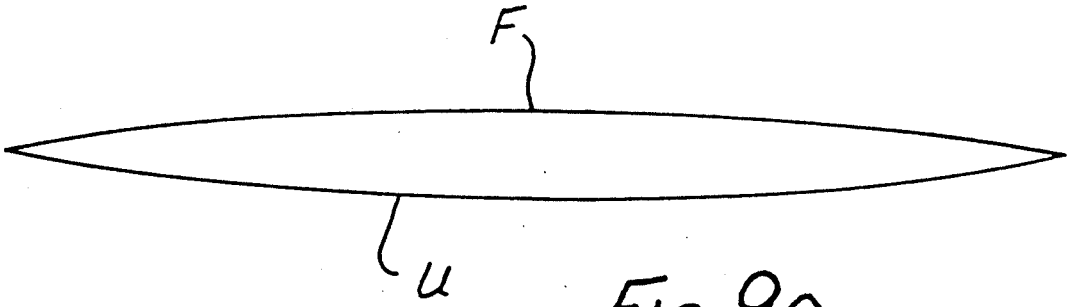
Fig. 9c

COLLAPSIBLE BRIDGE

BACKGROUND OF THE INVENTION

The present invention relates to a collapsible bridge particularly a military bridge being comprised of a plurality of interconnectable bridge elements.

German Patent 31 38 853 discloses a collapsible bridge of the type to which the invention pertains and wherein particularly the elements to be coupled together have the same elevation or height. Such a bridge can indeed be assembled and erected rather quickly. On the other hand for transporting the bridge sufficient for spanning 40 m, on one does need several vehicles. There is, clearly, a need towards simplification in collapsible bridge construction to facilitate transport without compromising its structural integrity.

DESCRIPTION OF THE INVENTION

It is an object of the present invention to provide a new and improved bridge particularly for military purposes which overcomes the aforementioned drawbacks and which permits transport to the installation site with as few vehicles as possible and which on the other hand is of a variable length.

In accordance with the preferred embodiment of the present invention, the object is attained through similarly constructed bridge elements each being comprised of and including one or several road or track plates as well as girders and diagonal struts and that the bridge elements are adjustable as to height. Particularly the track plates when assembled form an arch and the secant thereof is formed by the girders acting as lower stringers. On the other hand the relation may be reversed, the girders may establish an arch and the track plates then establish the secant. Still alternatively both kinds can be of arch shaped configuration can be used.

The elevation will be adjusted through a telescopic structure in the diagonal struts. In accordance with the invention a lattice kind of frame is thus established being comprised of struts and girders in conjunction with the platform, plates. Here the individual bridge elements can be adjusted as to elevation in a symmetrical fashion to obtain parallelism between track plates and girders or asymmetrically in order to obtain the relationship between curvature and secant element. It is essential that the bridge elements are similarly constructed but adjustable to accommodate different orientation of the plates and of the girders individually as well as in conjunction with analogous construction parts of the respective adjacent bridge element.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 9 illustrates three different bridges with three different curvatures.

Processing now to the detailed description of the drawings, FIGS. 1 and 2 illustrate the versatility of the inventive construction. FIG. 1 shows actually four different bridges each being comprised of one or a plurality of bridge elements B. Each element B is comprised of two track plates F, two girders U and several diagonal struts or tie rods D. The bridges illustrated respectively are assumed to have 6.5, 13, 21 and 27 m in span length. The lattice structure is particularly noticeable on account of the different configuration.

The assemblies are such that the plates F when assembled and from an overall point of view, approximate an arch. The approximation is the "finer" the more elements B are being used. The girder elements U are arranged in each instance and along in the secant of the overall curvature as comprised and established by the plurality of plates F.

Figures 1A, 1B, 1C, 1D:
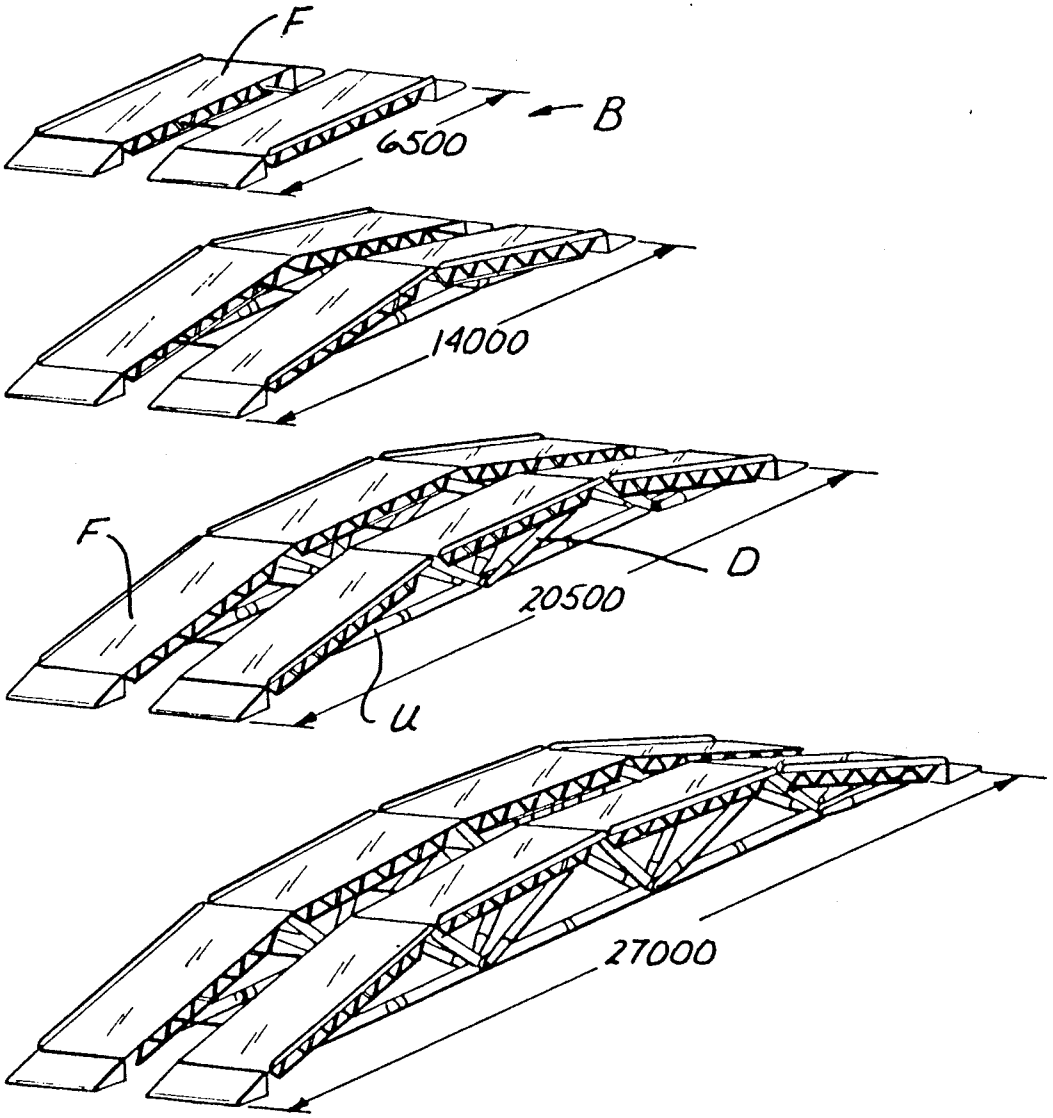
FIG. 1 and FIG. 2 illustrate several bridges of different length constructed of elements in accordance with the preferred embodiment of the present invention for practicing the best mode thereof.
Figure 2A:
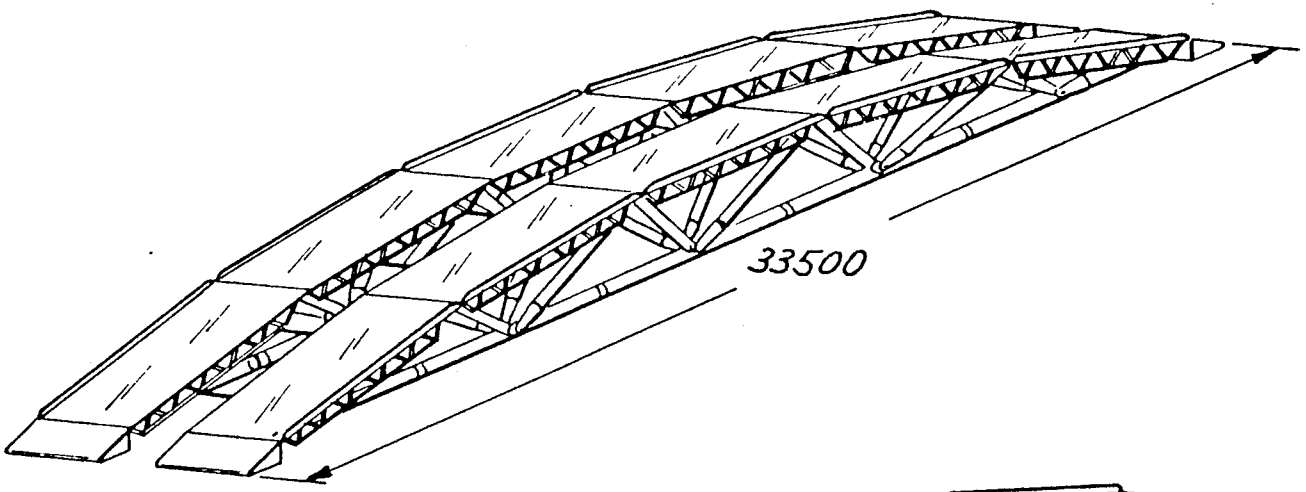
Figure 2B:
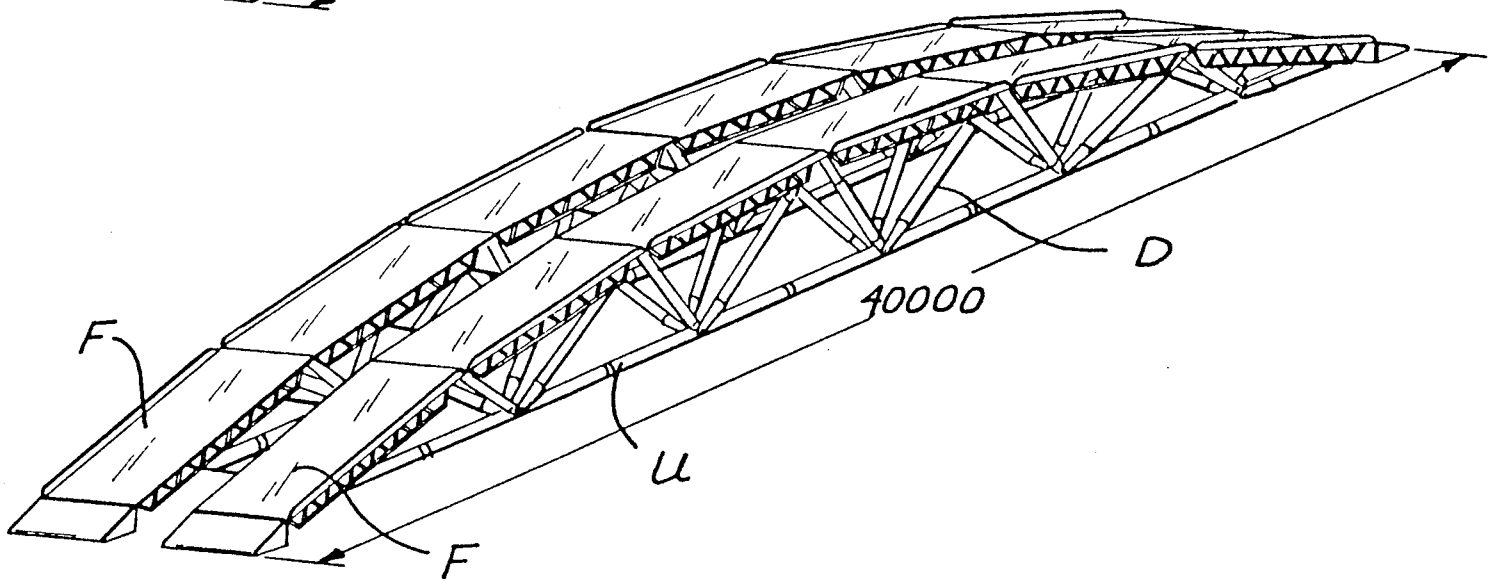

FIG. 2 illustrates analogously two different bridges illustrating further larger scale configurations and its possibilities. It is assumed that these bridges have a length respectively of 33.5 and 40 m.

Figure 3A:
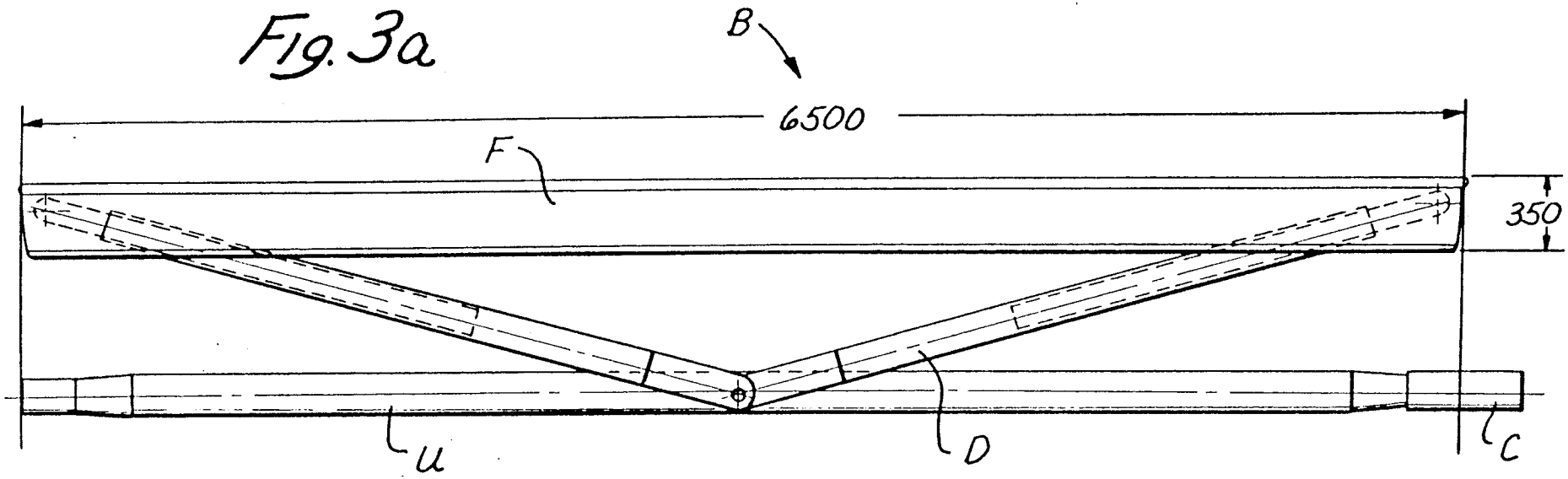
FIG. 3*a* is a schematic side view showing an upper and a lower part the construction of a bridge element.
Figure 3B:
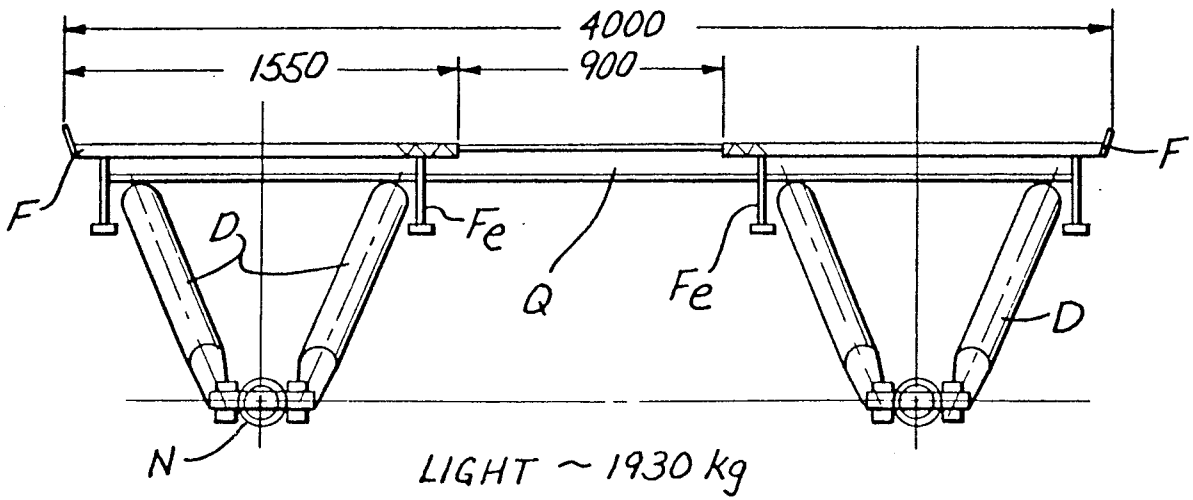
FIG. 3*b* is a front view of FIG. 3*a;*

FIG. 3 and 3*b* illustrate a bridge element B in side viewing and front view respectively. Element B is comprised, basically, of two plates F on which the wheels of vehicles will run just one plate F is visible in FIG. 3*a*. Two girders U are provided per bridge element; only one is visible in the side view of FIG. 3*a*, both are seen in 3*b*. The girders are connected to the respective plates F via four diagonal struts D. The figures are labeled with exemplary dimensions. FIG. 3*b* moreover shows in addition a transverse carrier Q interconnecting the two plates F that pertain to the one bridge element B.

The diagonal struts or tie rods D and the girders U can be lowered into the plates F during transport. The plates F, therefore, have a U-shaped cross section facing down (see legs $F_l$). On the other hand one can use other configurations, particularly as far as the diagonal struts D are concerned. One may use struts which are at least approximately arranged perpendicular to the plates F. Upon changing the length one can perpendicular to the plates F. Upon changing the length one can indeed approximate the desired curvature of the bridge. However, the diagonal configuration is deemed more stable. It is important however that the end of the track plates F are connected to different struts or tie rods, which can be adjusted individually. This way one obtains an oblique orientation of the plates F vis-a-via the girders V.

Figures 4A, 4B, 4C, 4D:
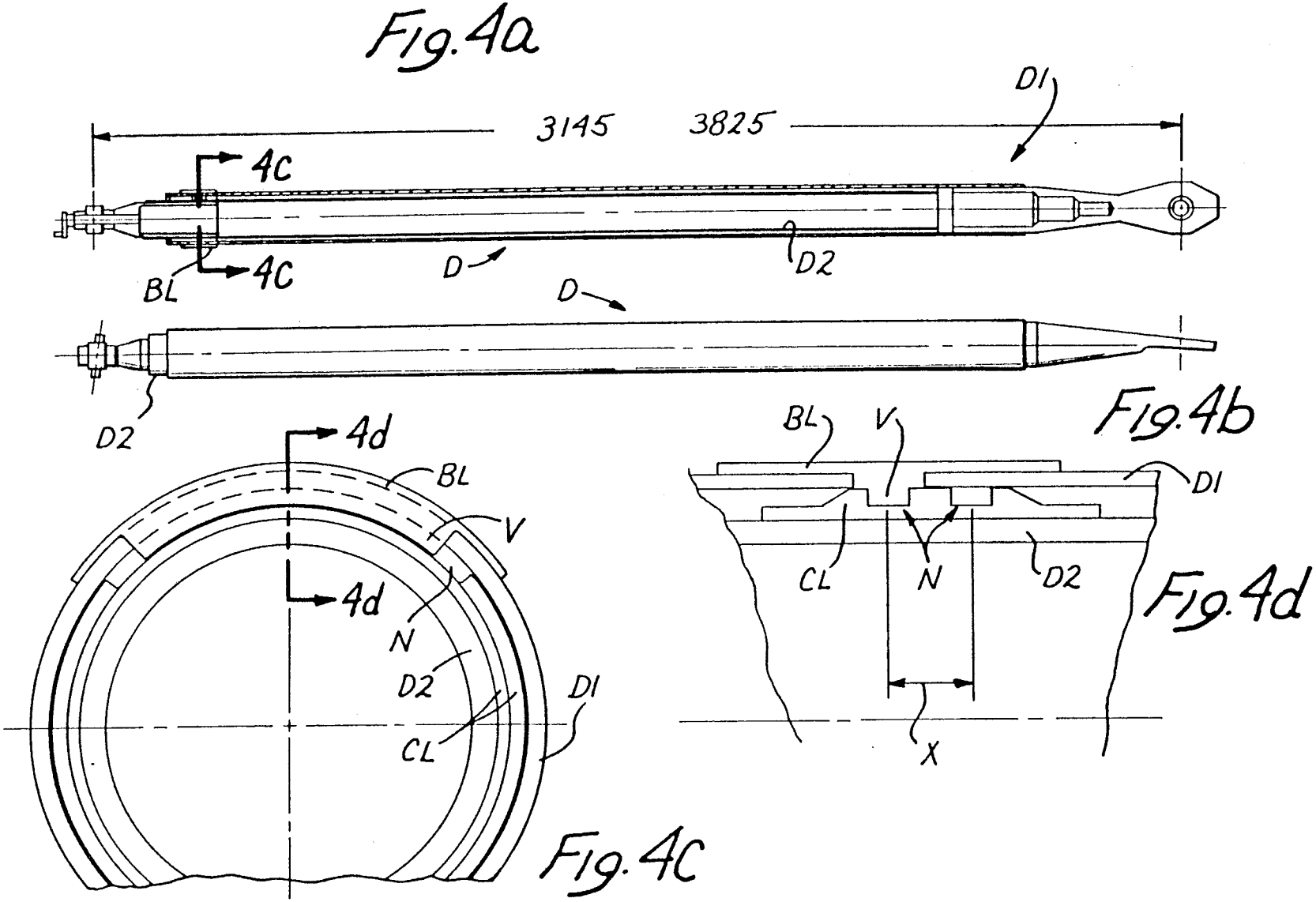
FIG. 4*a* is a longer inclined section through diagonal strut or tie rod.
FIG. 4*b* is a side view through the tie rod of FIG. 4*b;*
FIG. 4*c* is a section as indicated by C in FIG. 4*a;*
FIG. 4*d* is a section as indicated by D in FIG. 4*c;*

FIGS. 4*a*–4*d* illustrate a particular diagonal strut or tie rod D mad of two parts D1 and D2 and in each instance can be shifted and adjusted in relation to each other. This way the strut or tie rod can be changed in length from a minimal length of 3.1 m to a maximum length of 3.8 m. Length changes and locking is carried out with the aid of protrusion V and grooves N which can be caused to engage in respect to each other. The projections V and the grooves N are of the arch shaped configurations, as shown in FIG. 4*c*.

The locking is obtained through a lock element BL being a part of one tie rod element, e.g. D1 and having a projection V. A counterlock CL is part of or mounted on the other tie rod element, counterclock CL, D2 is provided with the grooves N. Upon turning the two parts D1 and D2 of the diagonal tie rod D in relation to each other by about 90 degrees the projections V can be shifted out from the respective groove N and in the case of turning in an opposite direction they may be latched back, possibly after an axial shift e.g. by the distance x also the projection with another groove N. This way simple latching and unlatching is accomplished while on the other hand one can change the length of the overall element by this easy manipulation.

Figure 5A:
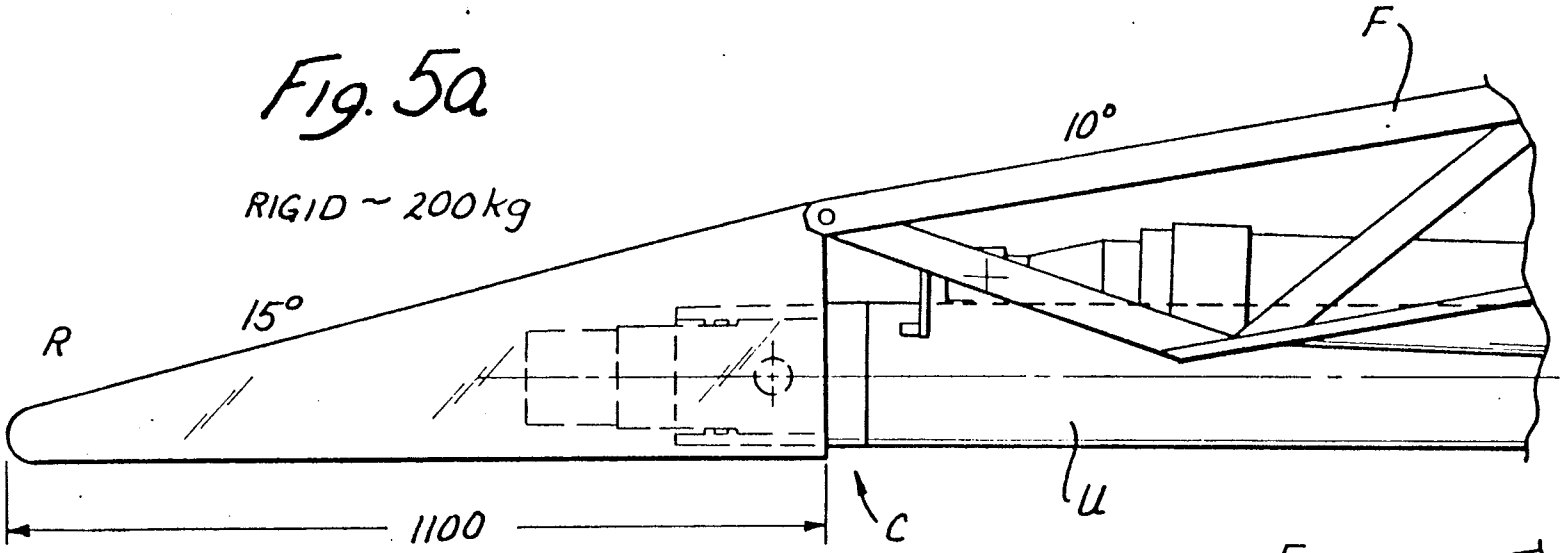
FIGS. 5*a* and 5*b* illustrate two different ramps.
Figure 5B:
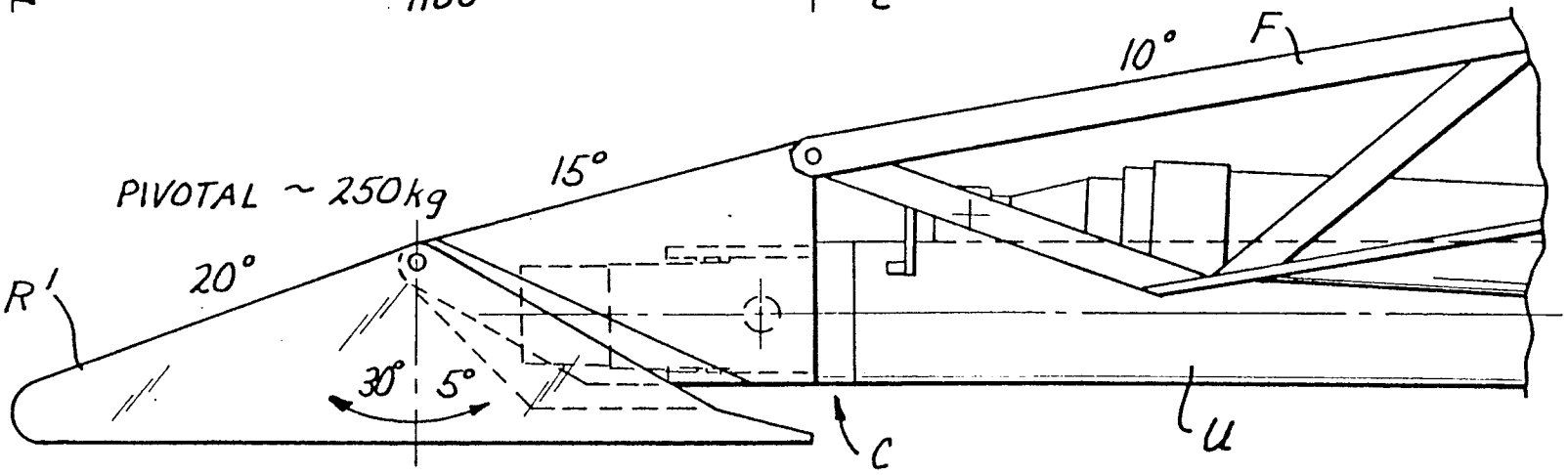

FIG. 5*a* and 5*b* illustrates two possible ramps such as R and R'. The upper ramp R is rigid and is of very low weight, particularly lower is the weight of the pivotal ramp R' in FIG. 5*b*. The ramps R and R' act in conjunction with the track plates F as well as the girders U. Again the figures show labels that indicate dimensional values for the various angles of pivoting and normal structural inclination.

Figure 6:
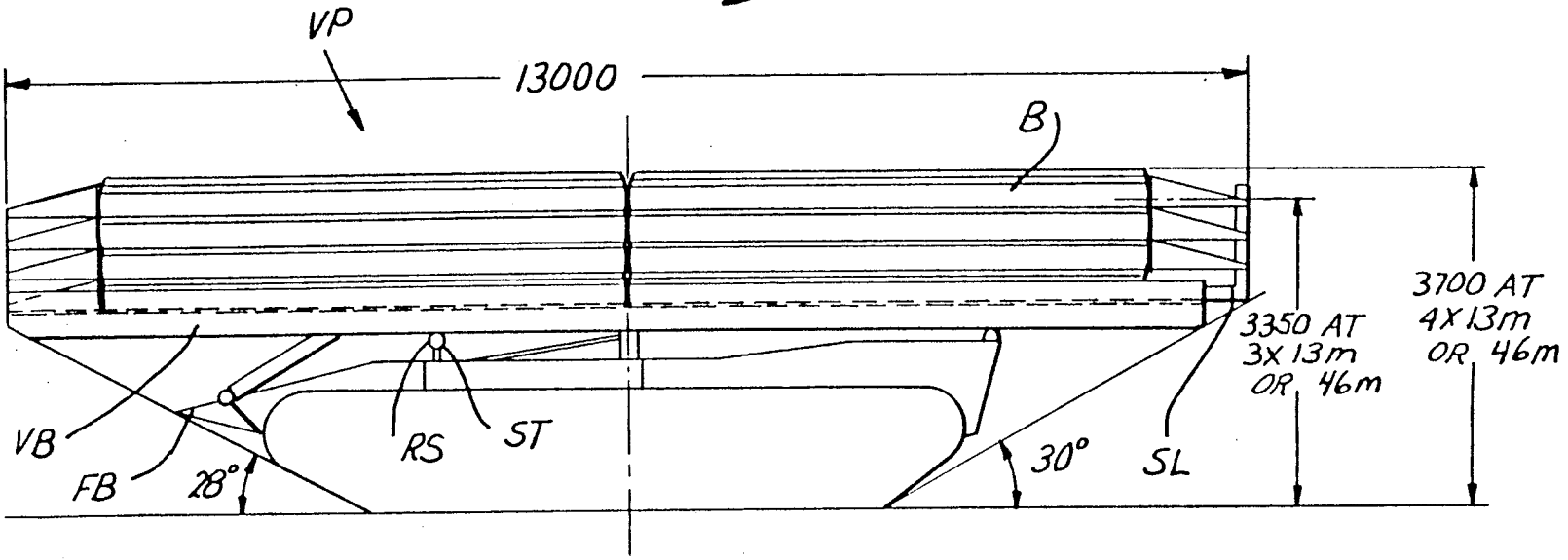
FIG. 6 illustrates in side view together with supplemental sketches (FIGS. 6*a*, 6*b*, 6*c*) a vehicle for placing a bridge and bridge parts.
Figure 6B:
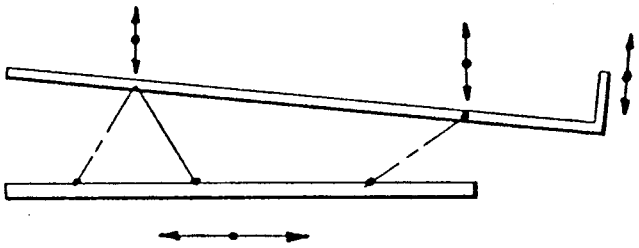
Figure 6C:
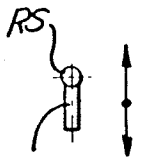
Figure 6A:
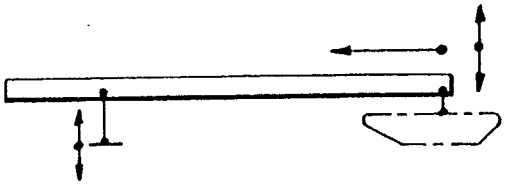

FIG. 6 illustrates the installment and bridge placement vehicle VP carrying altogether 46 m length (span) of bridge. The bridge is in effect mounted on a carriage or sled SL as far as the individual bridge elements B are concerned. The carriage or sled SL includes a lifting and lowering device on one hand as well as pivoting and tilting equipment. The movability and adjustability are shown FIG. 6*b*. The vehicle VP has a placement boom VB provided with a foot FB through which the tilting momentum of the device VP can be increased to a considerable extent. Thus, it is possible to provide indeed for the erection of 46 m span bridge in free unsuspended forward projection. The vehicle VP moreover has in its middle part a support ST which can be shifted up and down (see FIG. 6*c*). The support ST carries a roller RS on its upper side by means of which the boom VB can be pivoted.

Figures 7A, 7B, 7C:
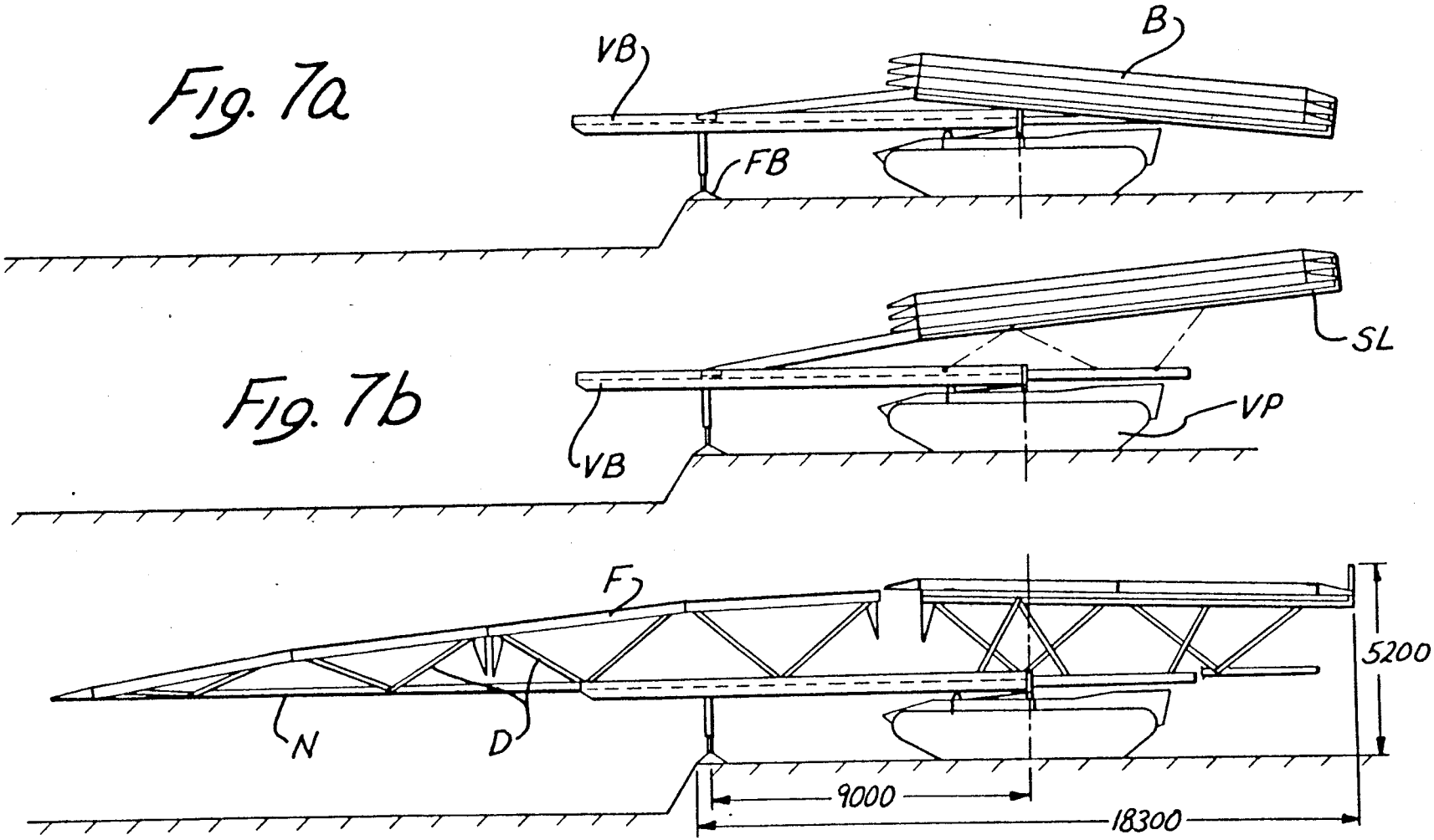
FIGS. 7*a*, 7*b* and 7*c* are somewhat schematic illustration showing projection of deployment, erection and installation of a bridge.
Figure 8A:
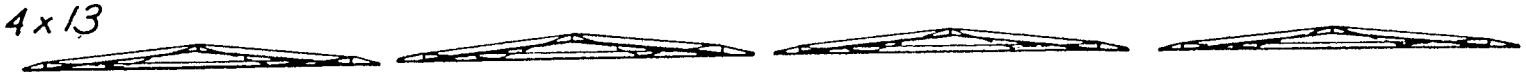
FIG. 8 illustrates several bridge combinations of the kind that can be assembled together with and with the aid of vehicles shown in FIG. 6.
Figure 8B:
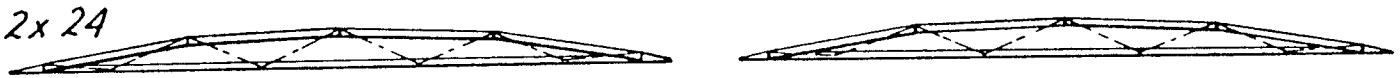
Figure 8C:
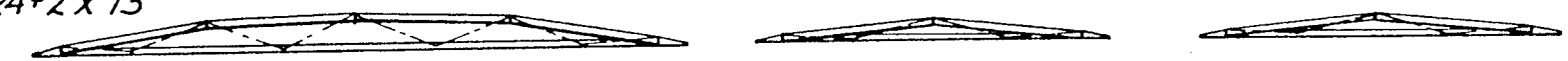
Figure 8D:
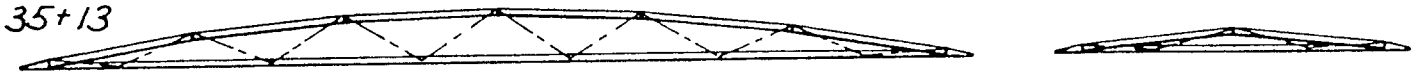
Figure 8E:
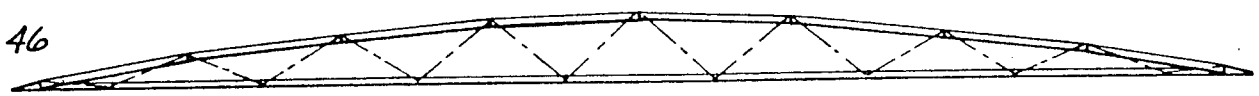

FIGS. 7*a*, 7*b* and 7*c* illustrate various phases in the installation and erection of a bridge by means of the vehicle VP. First (FIG. 7*a*) the bridge elements B are moved to the back of the vehicle by means of sled SL. On the other hand the installation boom VB with a foot FB is moved in forward direction. Next (FIG. 7*b*) the sled is tilted so that the bridge element B has the respective diagonal struts and tie rods D as well as the girders U placed in the desired level. FIG. 7*c* illustrates the actual installation procedure when already in a rather progressive state. The completed bridge elements will then be interconnected while still on the vehicle VP and after that, they are shifted through the installation boom VB across whatever obstacle is to be bridged. By way of example certain space requirements exist e.g. in the shore and they are shown in FIG. 7*c*.

FIG. 8 illustrates a variety of combinations of bridge elements by means of which numerous kinds of bridges can be installed and erected through a single vehicle. For example one can provided four bridges of 30 m span length configuration or span two bridges being 24 m long, or single bridge that is 24 m long plus two being 13 m long or a single bridge with a 46 m span. FIG. 9 illustrates three types of bridges of the kind assembled by means of the inventive bridge elements B. The upper parts shows the track configured through and established by the plates F and they are in a planar configuration while the undergirder assembly V provides for a curvature part. The middle part of the figure, the track, is curved and the girders run along the secant or in the lower part both the track assembly and the girders are curved. For reasons of simplicity the struts and tie rods D are not shown but their assembly is analogous to the one shown above.

Hence one can see that bridges are configured in which one or the other or both of the essential elements are arranged in an arch shaped configuration while the other one is either arch shaped or straight in relation to the first one. In terms of bridge elements, these variations in overall bridge configurations have to do with the interconnection of bridge elements to each other. The bridge elements themselves are adaptable to either configuration, simply through asymmetric length extension of these tie rods and struts D, thereby changing the angle of orientation between plates F and girders U. Also, if necessary the bridge can be made higher in the center than the in the end. The diagonal struts and tie rods can be folded together. The low weight and the small dimensions for transport permit e.g. a bridge strong enough to permit passage of a tank over a span length of 40 m, to be mounted on one particular vehicle. All bridge sections are similarly constructed and they are mounted on the same vehicle so that the extension of different bridge length can actually be automated.

The inventive bridge has the following advantages very few and only small spare parts are needed. The area exposed to attack by wind is minimal. The area that can be shot at and hit is likewise minimal. The construction is of great variability, that means as shown in FIG. 8 one can build one very long bridge or several short ones using the same assembly set on one particular transport vehicle. No boom extension is necessary up to 45 m bridge. The volume of transport is low and the weight of bridge is low. The bridge is easily visible by a tank driver as he approaches the bridge. The parts can be exchanged manually and spare parts are readily carried along in an easy fashion. For example a telescope strut D used weigths about 56 kg, one girder element U weights about 150 kg, a coupling C weights 200 kg. Owing to the stiffness and low mass the overall resonance frequency is higher. If one particular bridge section is no longer being used where installed it can be reused elsewhere. The overall available length is reduced but the system as a whole will not drop out. The device is of open construction so that coupling and other critical areas are freely accessible for manipulation as well as using. All parts are of building block configuration and thus interchangeable; there is no tactical limitation as far as the decision about the requisite length of the bridge is concerned.

It can thus be seen that it is essential for the invention that the length of the assembly of track plates F and of girders U are variable from an overall point of view so that the variable elevation, variable inclination and variable relative disposition of the girders in relation to the track are given plate of any bridge element governs the whole range of configurational variability. This is obtained through the telescopic and adjustable elements as described, namely, the plates F, the struts and tie rods D and the girders U. All elements required here should have coupling and clutch ends whereever needed. In a preferred embodiment a diagonal strut (tie rod) and/or the girders are of telescopic construction as stated.

The bridge moreover has a particularly favorable relationship as far as carrying capability in relation to the weight. This is particularly in case the height-to-length ratio is within 1 to 10 and 1 to 30 and preferably 1 to 20. Such a bridge has adequate carrying capability.

The invention is not limited to the embodiments described above but all changes and modifications thereof, not constituting departures from the spirit and scope of the invention, are intended to be included.

I claim:

1. Collapsible bridge for military purposes comprised of a plurality of similarly constructed interconnecting bridge elements wherein each bridge element includes at least one track plate having a longitudinal directional dimension, at least one length adjustable girder extending generally in said directional dimension and at least one length adjustable diagonal strut and tie rod extending also in said directional dimension and being interconnected and configured so that the bridge element as a whole and individually is adjustable as to elevation and relative orientation of the girder with the respect to the track plate.

2. Bridge as in claim 1, at least one of said diagonal strut and girder being of telescoping and connectable arrestable construction.

3. Bridge as in claim 2, said telescoping construction having arch shaped projection cooperating with arch shaped grooves.

4. Bridge as in claim 1, each element has two track plates, two girders and an even number of diagonal struts which are respectively linked on the ends of the plates and the center of the girders, there being transverse connectors between the track plates.

5. Bridge as in claim 4, the transverse connectors including transverse carriers extending between and being connected to the two plates.

6. Bridge as in claim 2, the height to length ratio of the bridge being adjusted to about 1:20.

7. Collapsible bridge for military purposes comprised of a plurality of similarly constructed lengthwise interconnected bridge elements wherein each bridge element includes at least one track plate at least one length adjustable girder and at least one length adjusted diagonal strut and tie rod, all extending basically lengthwise and being interconnected and configured so that the angular orientation of the girder is adjustable in relation to the track plate, the mutual respective angular orientation are differently adjustable for different ones of the interconnected bridge elements such that either the track plates or the girders or both approximate arches.

8. Bridge as in claim 7, each element has two track plates, two girders and an even number of diagonal struts which are respectively linked to the ends of the plates and the center of the girders, further including transverse carriers extending between and being connected to the two plates.

9. Bridge as in claim 7, said plates having U shaped configuration to receive said girders and said rods when collapsed for purposes of and during transport.

* * * * *